United States Patent [19]

Grieb

[11] Patent Number: 4,899,498

[45] Date of Patent: Feb. 13, 1990

[54] FOAM CEMENT HIGHWAY SOUND BARRIER

[76] Inventor: Donald L. Grieb, 2001 Chateau Ct., Grafton, Wis. 53024

[21] Appl. No.: 253,063

[22] Filed: Oct. 3, 1988

[51] Int. Cl.[4] ..... E04B 1/82; E04B 2/58

[52] U.S. Cl. ..... 52/144; 52/145; 52/157

[58] Field of Search ..... 52/144, 145, 157, 299; 181/210; 428/44, 45, 47, 48, 49, 53, 54, 256, 319.9

[56] References Cited

U.S. PATENT DOCUMENTS

| | | | |
|---|---|---|---|
| 2,460,309 | 2/1949 | Rapp | 428/49 |
| 2,692,219 | 10/1954 | Slayter et al. | 52/144 X |
| 3,149,693 | 9/1964 | Keller et al. | 52/144 X |
| 3,983,956 | 10/1976 | Manhart | 181/210 |
| 4,042,745 | 8/1977 | Cornwell et al. | 181/294 X |
| 4,094,380 | 6/1978 | Kobayashi et al. | 52/144 X |
| 4,125,664 | 11/1978 | Gieseman | 428/48 |
| 4,143,495 | 3/1979 | Hintz | 52/145 |
| 4,258,514 | 3/1981 | St. Clair | 52/157 X |
| 4,317,503 | 3/1982 | Soderquist et al. | 52/144 X |
| 4,325,457 | 4/1982 | Docherty et al. | 181/210 |
| 4,358,090 | 11/1982 | Glaesener | 52/144 X |
| 4,674,593 | 6/1987 | McCarty | 181/210 |

FOREIGN PATENT DOCUMENTS

| | | | |
|---|---|---|---|
| 3714089 | 11/1987 | Fed. Rep. of Germany | 52/145 |

*Primary Examiner*—Jerome W. Massie
*Assistant Examiner*—Matthew Smith
*Attorney, Agent, or Firm*—Foley & Lardner

[57] ABSTRACT

A highway sound barrier formed by one or more panels mounted in a vertical abutting relation, each of the panels being formed from one or more self-supporting foam cement blocks. Each of the blocks having a foam core, a reinforcement grid mounted on the exposed surfaces of the core and a cementitious coating applied to the reinforcement grid for securing the grid to the foam core and to increase the compressive strength of the blocks. Thicknesses of the blocks being sufficient to form a load bearing structure. The panels being anchored to the ground by a helical screw anchor rod embedded in a concrete pad, with the support posts being mounted in either a common verticle plane or alternately offset.

13 Claims, 2 Drawing Sheets

FOAM CEMENT HIGHWAY SOUND BARRIER

BACKGROUND OF THE INVENTION

1. Related Application

This application contains subject matter common to my earlier filed co-pending application serial no. 588,323 filed Mar. 12, 1984, now U.S. Pat. No. 4,774,794 issued 10-4-88 entitled "Energy Efficient Building System".

2. Field of the Invention

The present invention relates to highway sound barriers which absorb and/or reflect sound from vehicles in traffic zones or sound environmental corridors, i.e., hospitals and residential properties, and for use at private residential sites.

3. Description of the Prior Art

It is well recognized that noise has become a major environmental problem. This is particularly true along freeways that pass through residential areas. On-going efforts have been made to attempt to reduce the noise level by the construction of sound barriers along the freeways. Such barriers have included both masonry walls of stone, brick or concrete, six to ten feet in height, and also wood planking and, in some instances, berms with shrubbery planted on the berms to defuse the noise. Although this has been of some help, it does not provide the protection from the noise that is desired. This is due to the use of materials such as masonry, brick or concrete which are not sound absorbing materials and only reflect the noise. Wood planking has also been used but is also solid and has limited sound absorbing capability.

SUMMARY OF THE INVENTION

The present invention relates to a sound absorbing and reflecting barrier formed from self supporting foam cement blocks, four feet wide, up to twenty feet long, and six to twenty-four inches thick. The strength of the blocks is enhanced by providing a coating of fiberglass reinforced cement on the outside surfaces.

One of the principal features of the present invention is the ability to precut the blocks to the desired size and cover the blocks with a fiberglass reinforced cement composition at a manufacturing side and then transporting the blocks for assembly at the construction site.

A further feature of the invention is the ability to provide the outside surface of the panels with various aesthetic and functional characteristics.

Another feature of the invention is the use of the fiberglass reinforced cement on the surfaces of each block to provide weather resistance, and increased structural strength which, in combination with the foam, can support loads in excess of the wind, snow, dead and live loads required for highway use.

Another feature of the invention is the light weight of the building blocks due to the use of foam panels which minimizes the transporting and assembling time of the blocks at the construction site.

Other features and advantages of the invention will become apparent to those skilled in the art upon review of the following detailed description, claims and drawings.

DETAILED DESCRIPTION OF THE DRAWINGS

Figure 2:
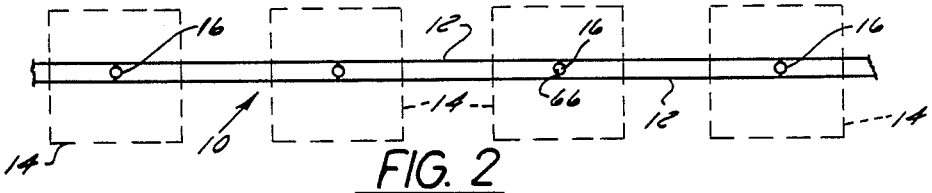
FIG. 2 is a top view of the barrier shown in FIG. 1.

Before describing any embodiments of the invention in detail, it is to be understood that the invention is not limited in its application to the details of construction or the arrangements of the components as set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF AN EXEMPLARY EMBODIMENT

Figure 1:
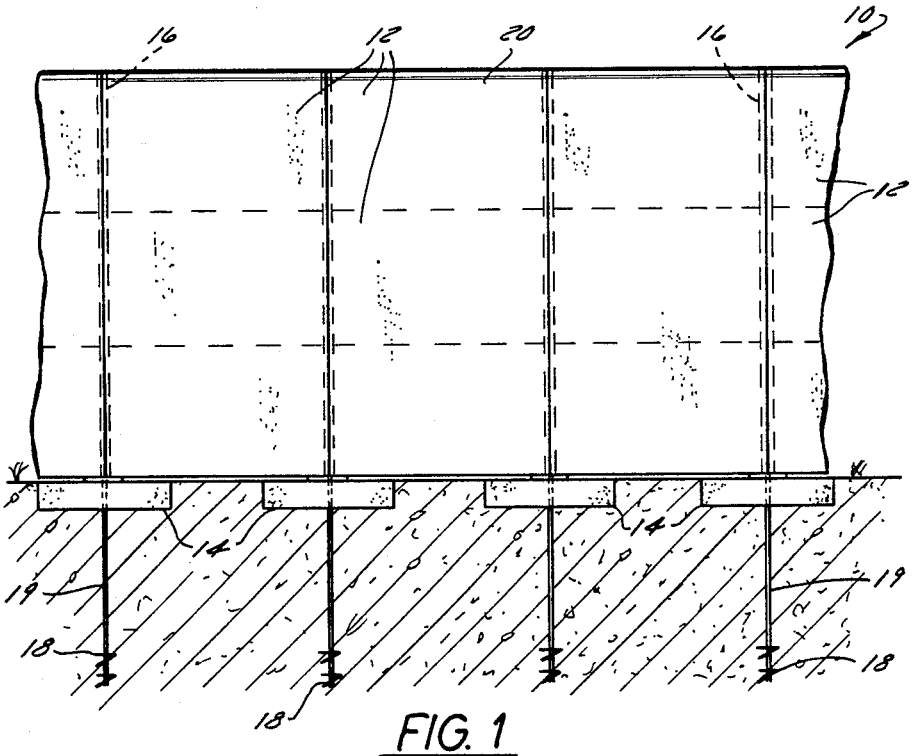
FIG. 1 is a front elevational view showing the sound according to the invention.

Referring to FIGS. 1 and 2 of the drawings, a sound barrier 10 is shown constructed in accordance with the present invention. The barrier 10 includes a number of panels 20 formed from one or more foam cement blocks 12 which have high load bearing characteristics and sound absorbing properties superior to conventional highway barriers. In this regard, it should be noted that the blocks are self-supporting and that no supporting structure is required for the construction of the barrier.

Means are provided at the ends of the blocks for interconnecting the joints of the panels formed by the blocks. Such means is in the form of a pad 14 having a tubular column or post 16 extending vertically from the pad 14. The pad 14 is secured to the ground by a unique structural tie-down and support system 15 using a helical single or double screw anchor 18 drilled or turned into the soil at predetermined intervals as described hereinafter.

The blocks 12 which are used to form the panels 20 each include a cellular foam core 22 having a thickness of four to twenty-four inches, depending on the contemplated wind loads. The blocks have a standard height of four feet and can be up to twenty feet in length. In a preferred embodiment, the load bearing blocks should be formed from a cellular foam material having a density of at least two pounds and a minimum thickness of six to fourteen inches. Various foam materials, such as extruded or expanded polystyrenes, phenolics and polyisocyanurate foams with various specific densities depending on the load bearing capacities can be used. One of the advantages of using these foam materials is there ability to resist frost and moisture as well as being termite free.

Figure 4:
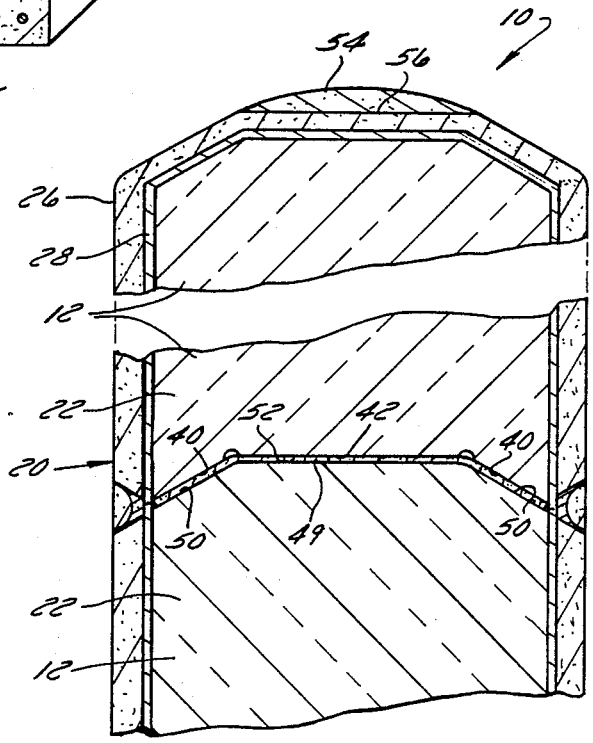
FIG. 4 is a cross-sectional view showing the interlocking connection between the self-supporting foam cement blocks and the coping.

The load bearing characteristics of the foam core is increased by providing means in the form of a thin, reinforced fiberglass coating 26 on the outer surface of the blocks or panel. In this regard and referring to FIG. 4, a cross section of a portion of one of the panels 20 is shown. As seen in FIG. 4, the blocks include a foam core 22 having a cementitious coating 26 on the outer surfaces. The coating 26 can be provided on the exposed surfaces of the cores of an entire outer surface of the core 22. The cementitious coating is reinforced by means of a fiberglass fabric or mat 28 or a polypropalene reinforcement mesh such as Plastic-Mesh C-Flex made by Tenax Co. a subsidiary of ATP Corp. which is provided on the surface of the core 22. The fabric or mat 28 is covered with a cementitious material described hereinafter. The coating, as shown, forms a solid layer approximately ¼ to ½ inches thick.

The coating 26 includes a single layer of fiberglass reinforced fabric having a 3/16th inch by 3/16th inch grid or a polypropylene mat having a grid spacing of ½ to ¾ of an inch. The cementitious material 28 includes Portland cement type N, sand, water and 178 inch to ¾ inch cut fiberglass roving strands. These ingredients are mixed with the water to which is added a liquid polymer adhesive material.

A typical admixture for the cementitious coating contains the following:

1 bag Portland type Cement N (white or gray) —94 pounds;

1 ½ parts sand—150 pounds;

1 pound cut fiberglass roving added to the sand and cement;

4 gallons of water (additional as needed for plastic mix); and 1 gallon polymer adhesive acrylic material.

This material is laid over the fiberglass reinforcing mat and penetrates the mat to bond the mat to the surface of the foam blocks. A structural finish surface bonding cement may be applied to the coating 26 to provide color to the coating. The foam block 24 may be prime coated with an adhesive polymer to increase the bonding characteristics of the foam block to the cementitious material 28.

The addition of the cementitious or thermal barrier coatings to the foam blocks develops super strong load bearing strengths. The coatings are sun resistant, frost-free and non-cracking. The coating can be modified to a variety of surface textures and colors with added color mixes for color styling.

The panels 20 for the walls are formed by merely stacking the blocks 12 in a vertical relation between the posts 16. As seen in FIG. 1, three blocks are shown forming each of the panels 20 . It should be understood that the blocks are preformed and, therefore, can be manufactured to exact sizes and shape required for the barrier. Various means can be provided for forming the joints at the edges of adjacent blocks.

In this regard and referring to FIG. 4, a typical joint between adjacent, vertical blocks is shown. As seen in FIG. 4, the upper edge of each block is provided with a generally convex surface formed by two upwardly inclined surfaces 40 which terminate at a flat surface 42. The bottom of each block is provided with a corresponding generally concave surface having upwardly inclined surfaces 50 and a flat surface 52. The blocks are stacked by matingly engaging the upper convex surface with the corresponding lower concave surface of the upper block and can be joined by adhesives of the type sold under the name "Max-Bond" a trademark of H. B. Fuller Co. or "Bond Master" a trademark of National Starch and Chemical Co. It should be noted that at the upper surface of the panel a coping 54 is formed by applying cementitious material to the flat surface 56 on the top block.

The barrier 10 is supported at the ends by means of the cement pads 14 which are secured in the ground by helical screw anchor rods 18. The rods 18 include a threaded section 19 which extends upward to the point of grade elevation for the concrete pad. A nut 21 is provided on the threaded section above the grade elevation for embedding in the cement pad. The cement pads are formed by pouring concrete into the footing openings 25.

Means are provided on the cement pad for supporting the tubular column 16. Such means is in the form of a plate 60 secured in the cement pad by means of anchor bolts 62. A threaded post 64 is secured to the top of plate 60. The tubular column 16 is provided with an internal threaded at the lower end for matingly engaging the threaded post 64. The post 16 can also be welded to the plate 60.

Figure 6:
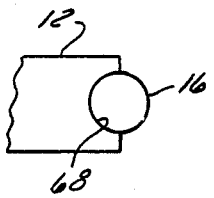
FIG. 6 is a top view of the joint connection of the barrier of FIG. 2.
Figure 5:
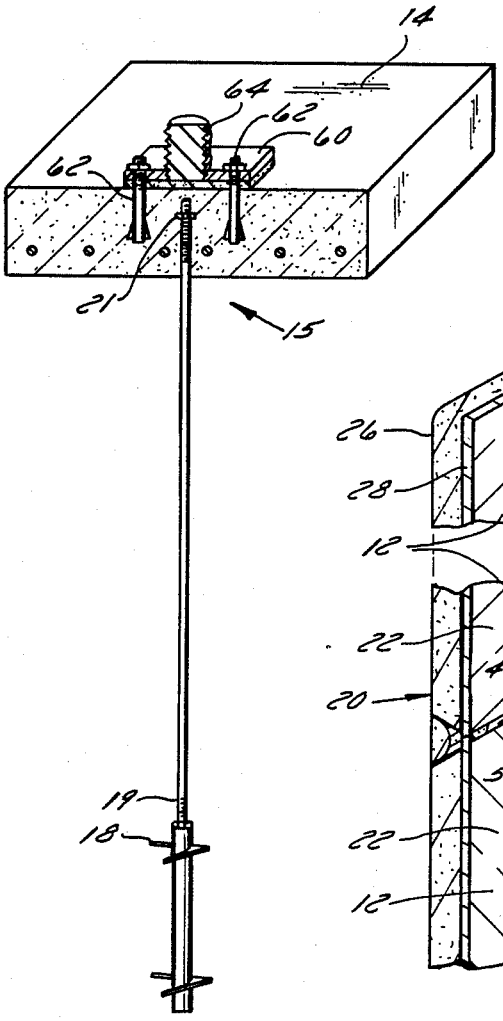
FIG. 5 is a cross section-isometric view of one of the tie mounting assemblies.

The barrier 10 can be formed in a number of ways. Initially, the cement pads 14 should be poured and anchored in position. A single post 16 is erected on one of the threaded posts 64. As seen in FIG. 6, each block 12 is provided with a semi-circular groove 66 on each end. The first block 12 is placed on the two adjacent pads 16 with the groove 66 abutting the tubular post 16. The second block 12 is then stacked on the first block 12 with the surfaces 40 and 42 abutting the corresponding surfaces 50 and 52 and the groove 66 aligned with post 16. If a third block is used, it is stacked on the second block in the same manner. The blocks are then locked into position by positioning a second post 16 in the grooves 66 at the opposite end of the blocks. The post 16 is then screwed down on the threaded post 64. An adhesive such as described above can be used to secure the blocks to the post 16.

Figure 3:
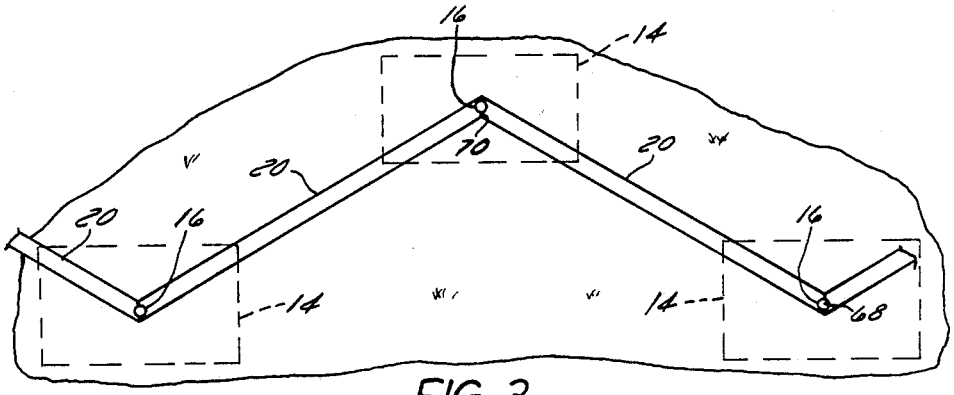
FIG. 3 is a top view of an alternate arrangement of the panels forming the barrier wall.
Figure 7:
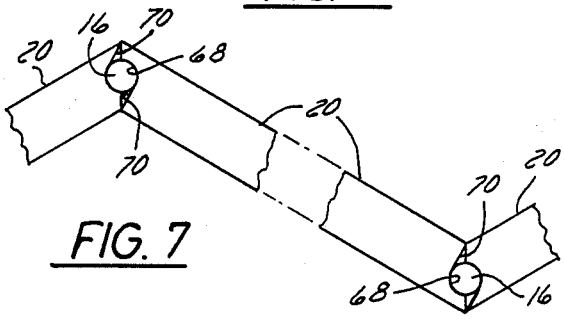
FIG. 7 is a top view of the joint connection for the barrier of FIG. 3.

An alternate arrangement for assembling the panels is shown in FIG. 3 wherein the panels are offset at 120° angles from each other. As seen in FIG. 7, each of the blocks includes a semi-circular opening 68 which is cut off at 70 to allow for the blocks to be turned into the posts 16 during assembly. With this arrangement, both the wind resistance and sound absorbing characteristics are enhanced. With respect to wind resistance, the panels, when so arranged will not be subjected to the full force of the wind in any direction. With respect to sound, the offset angles will reflect the sound in different directions off of each panel so that a direct reflection of sound cannot occur.

Thus, it is apparent that there has been provided in accordance with the invention a highway sound barrier that fully satisfies the aims and advantages set forth above. While the invention has been described in conjunction with specific embodiments thereof, it is evident that many alternatives, modification and variations will be apparent to those skilled in the art. Accordingly, it is intended to embrace all of such alternatives, modifications and variations as fall within the spirit and broad scope of the appended claims.

I claim:

1. A highway sound barrier comprising:

a number of panels mounted in a vertical abutting relation;

each of said panels being formed from one or more self-supporting foam cement blocks;

each of said blocks being formed from a load bearing foam core;

a reinforcement grid mounted on the exposed surfaces of said core; and a cementitious coating applied to the reinforcement grid for securing the grid to said foam core, said block having a sufficient thickness to form a load bearing structure.

2. The barrier according to claim 1 wherein said coating is formed from a composition including Portland cement, sand, cut fiberglass roving strands and a polymer adhesive, said composition being applied to said reinforcement grid to bond the grid to the core.

3. The barrier according to claim 1 or 2 wherein said reinforcement grid is woven from fiberglass to form a perforate fabric.

4. The barrier according to claim 1 or 2 wherein said reinforcement grid is formed from a polypropylene mesh.

5. A highway sound barrier comprising:

a number of posts mounted in a spaced relation;

a number of sound absorbing panels supported in a vertical relation between said posts;

each of said panels being formed from one or more self-supporting foam cement blocks;

each of said blocks including means on the edges for matingly engaging said posts on said adjacent blocks;

each of said blocks having a cellular load bearing foam core; and a cementitious coating on the exterior surfaces of said foam core;

said coating including a fiberglass mat.

6. The barrier according to claim 5 wherein said coating is formed from a composition including fiberglass roving strands mixed therein, said composition penetrating the mat to bond the coating to the core.

7. The barrier according to claim 5 wherein said mat is in the form of a perforate fabric.

8. The barrier according to claim 5 wherein said mat is in the form of a grid.

9. The barrier according to claim 5 or 6 wherein said roving strands are cut in lengths of 178 to $\frac{3}{4}$ inches.

10. The barrier according to claim 1 or 5 including means for supporting the ends of said barrier.

11. The barrier according to claim 10 wherein said supporting means comprises a helical screw anchor rod turned into the ground, a concrete pad embedded in the ground at ground level and means for connecting said concrete pad to said screw anchor rod.

12. The barrier according to claim 1 or 5 wherein said posts are mounted in a common vertical plane.

13. The barrier according to claim 1 or 5 wherein said posts are alternating offset from the adjacent posts whereby said panels are angularly offset from the adjacent panels.

* * * * *